US010208601B2

(12) United States Patent
Nereim et al.

(10) Patent No.: US 10,208,601 B2
(45) Date of Patent: Feb. 19, 2019

(54) AIR SEPARATOR FOR A TURBINE ENGINE

(71) Applicant: Siemens Energy, Inc., Orlando, FL (US)

(72) Inventors: Brian D. Nereim, Winter Springs, FL (US); Piyush Sane, Orlando, FL (US); Yevgeniy P. Shteyman, West Palm Beach, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 624 days.

(21) Appl. No.: 14/890,436

(22) PCT Filed: May 5, 2014

(86) PCT No.: PCT/US2014/036807

§ 371 (c)(1),
(2) Date: Nov. 11, 2015

(87) PCT Pub. No.: WO2014/186164

PCT Pub. Date: Nov. 20, 2014

(65) Prior Publication Data

US 2016/0123152 A1 May 5, 2016

Related U.S. Application Data

(60) Provisional application No. 61/823,186, filed on May 14, 2013.

(51) Int. Cl.
*F01D 5/08* (2006.01)
*F01D 5/02* (2006.01)
(Continued)

(52) U.S. Cl.
CPC ..... *F01D 5/081* (2013.01); *F01D 5/02* (2013.01); *F01D 5/082* (2013.01); *F01D 5/084* (2013.01);
(Continued)

(58) Field of Classification Search
CPC ..... F01D 5/081; F01D 5/082; F01D 5/085; F01D 11/001
See application file for complete search history.

(56) References Cited

U.S. PATENT DOCUMENTS 4,306,834 A 12/1981 Lee
5,639,216 A 6/1997 McLaurin et al.
(Continued)

FOREIGN PATENT DOCUMENTS

JP H08177526 A 7/1996

*Primary Examiner* — Justin D Seabe

(57) ABSTRACT

An air separator for a turbine engine is provided. The air separator includes an aft air separator member (10) having an annular frame (14) which defines a chamber (16) configured to engage disc shoulders (18) configured in a first stage of the turbine engine. The aft air separator member (10) is constrained from movement along a radial direction by the disc shoulders engaged in the chamber of the aft air separator member. A forward air separator member (12) is affixed at a forward end thereof to a torque tube (20) to constrain movement along the radial direction. The forward air separator includes at an aft end thereof a flange (22) that engages the aft air separator member. The forward air separator member is constrained from outward radial movement along the radial direction by way of a recess (24) constructed in a portion of the aft air separator member.

16 Claims, 3 Drawing Sheets

(51) Int. Cl.
*F01D 11/00* (2006.01)
*F01D 11/04* (2006.01)

(52) U.S. Cl.
CPC ..... *F01D 11/005* (2013.01); *F01D 11/04* (2013.01); *F05D 2220/3212* (2013.01); *F05D 2240/24* (2013.01); *F05D 2260/20* (2013.01); *F05D 2260/30* (2013.01)

(56) References Cited

U.S. PATENT DOCUMENTS

| | | | | |
|---|---|---|---|---|
| 5,951,250 | A | 9/1999 | Suenaga et al. | |
| 6,065,282 | A | 5/2000 | Fukue et al. | |
| 6,120,249 | A | 9/2000 | Hultgren et al. | |
| 6,151,881 | A | 11/2000 | Al et al. | |
| 7,815,415 | B2 | 10/2010 | Kanezawa et al. | |
| 2010/0124495 | A1* | 5/2010 | Bifulco ..... | F01D 5/066 415/216.1 |

* cited by examiner

AIR SEPARATOR FOR A TURBINE ENGINE

CROSS REFERENCE TO RELATED APPLICATIONS

This application is the U.S. National Stage of International Application No. PCT/US2014/036807 filed May 5, 2014, and claims the benefit thereof. The International Application claims benefit of the 14 May 2013 filing date of U.S. provisional patent application No. 61/823,186. All applications are incorporated by reference herein.

FIELD OF THE INVENTION

The present invention is generally related to an air separator for a turbine engine, and, more particularly, to an air separator including an aft air separator member and a forward air separator member that are appropriately constrained to maintain an appropriate degree of concentricity in the rotor system of the turbine.

BACKGROUND OF THE INVENTION

A turbine engine, such as a gas turbine, generally includes a compressor section that produces compressed air. Fuel is then mixed with and burned in a portion of this compressed air in one or more combustors, thus producing a hot compressed gas. The hot compressed gas is then expanded in a turbine section to produce rotating shaft power.

The turbine section typically employs a plurality of rows of rotatable blades. Each of the rotatable blades has an airfoil portion and a disc portion by which it is affixed to a rotor. Since these components are exposed to the hot gas discharging from the combustors, cooling these components is of the utmost importance. An air separator for a gas turbine is a device for guiding cooling air from the compressor along the rotor to find its way to the turbine disks and eventually to the various rows of rotatable blades. U.S. Pat. Nos. 6,151,881 and 7,815,415 disclose air separators in a gas turbine engine.

BRIEF DESCRIPTION OF THE DRAWINGS

The invention is explained in the following description in view of the drawings that show.

DETAILED DESCRIPTION OF THE INVENTION

The present inventors have cleverly recognized that known air separator designs for turbine engines, such as gas turbine engines, tend to experience movement, such as movement or shifts along a radial direction that can result in the formation of mechanical imbalances in the rotor system of the turbine engine. This movement may be induced due to thermal changes (e.g., thermal growth) that may occur in the air separator relative to a turbine disk. The resulting mechanical imbalances can be a source of undesirable vibration in the rotor system. In view of such a recognition, the present inventors propose an innovative air separator comprising an aft air separator member and a forward air separator member that are appropriately constrained from movement along the radial direction, thus insuring an appropriate degree of concentricity in the rotor system notwithstanding of thermal changes that may occur during operation of the turbine engine.

In the following detailed description, various specific details are set forth in order to provide a thorough understanding of such embodiments. However, those skilled in the art will understand that embodiments of the present invention may be practiced without these specific details, that the present invention is not limited to the depicted embodiments, and that the present invention may be practiced in a variety of alternative embodiments. In other instances, methods, procedures, and components, which would be well-understood by one skilled in the art have not been described in detail to avoid unnecessary and burdensome explanation.

Furthermore, various operations may be described as multiple discrete steps performed in a manner that is helpful for understanding embodiments of the present invention. However, the order of description should not be construed as to imply that these operations need be performed in the order they are presented, nor that they are even order dependent unless otherwise so described. Moreover, repeated usage of the phrase "in one embodiment" does not necessarily refer to the same embodiment, although it may. Lastly, the terms "comprising", "including", "having", and the like, as used in the present application, are intended to be synonymous unless otherwise indicated.

Figure 1:
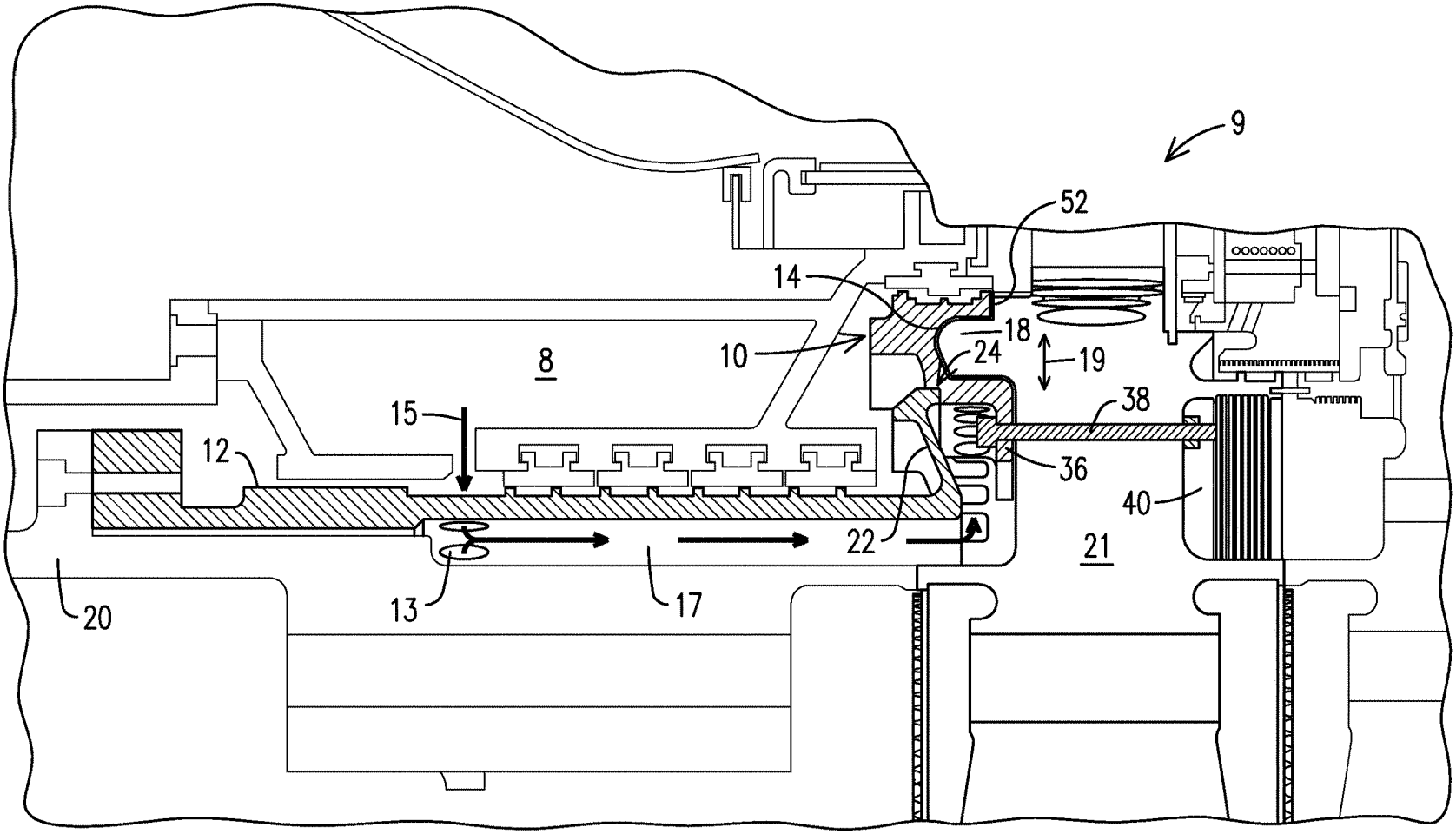
FIG. 1 is a sectional view of one non-limiting embodiment of an air separator as may be disposed in a turbine engine.

FIG. 1 is a sectional view of an air separator for a turbine engine 9, such as a gas turbine engine. In one non-limiting embodiment, the air separator comprises an aft air separator member 10 and a forward air separator member 12. A plurality of openings 13 is formed around the central portion of forward air separator member 12 for passing cooling air (schematically represented by arrow 15) from a space 8 into a passageway 17 formed between a torque tube 20 and the inner diameter of forward air separator member 12. The designation of "aft" and "forward" reflects the fact that in one non-limiting embodiment forward air separator member 12 is disposed forwardly with respect to aft air separator member 10 as the cooling air flows from left to right in passageway 17. It will be appreciated that aspects of the present invention are not limited to any specific arrangement regarding air separator members 10, 12.

Aft air separator member 10 comprises an annular frame 14 which defines a chamber 16 (FIG. 2) configured to engage disc shoulders 18 configured in a first stage of the turbine engine, which comprises a turbine disc 21. Aft air separator member 10 is constrained from movement along a radial direction (represented by arrow 19) by the disc shoulders 18 engaged in chamber 16 of the aft air separator member 10.

Forward air separator member 12 is affixed at a forward end thereof to torque tube 20 to constrain movement along the radial direction. Forward air separator member 12 comprises at an aft end thereof a flange 22 that engages aft air separator member 10. Forward air separator member 12 is constrained from outward radial movement along the radial direction by way of a recess 24 constructed in a portion of aft air separator member 10.

Figure 2:
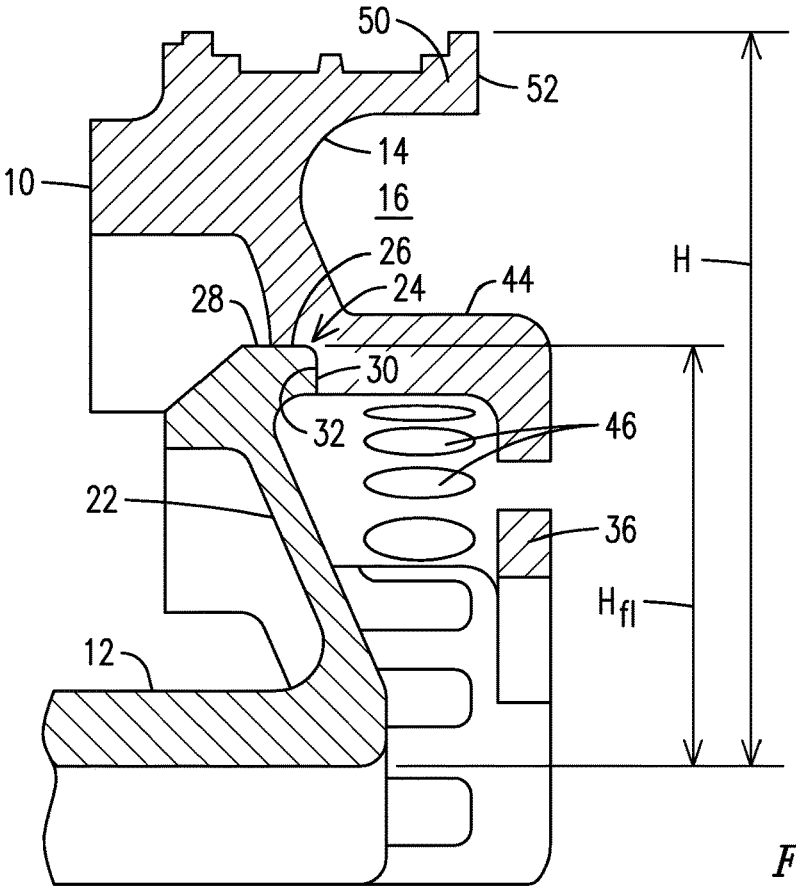
FIG. 2 is a zoomed-in view of a portion of the air separator shown in FIG. 1.
Figure 4:
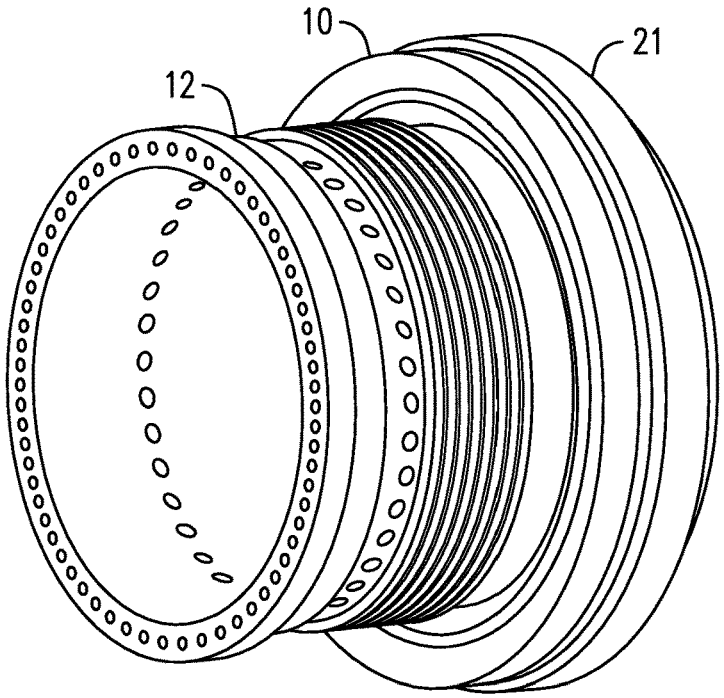
FIG. 4 is an isometric view of the air separator mounted onto the turbine disk.

In one non-limiting embodiment, as may be appreciated in FIG. 2, recess 24 comprises a recess surface 26 facing radially inward that opposes a corresponding flange surface 28 disposed at a radially outward end of the flange 22 of the forward air separator member 12. Recess 24 further comprises a recess surface 30 facing axially forward that opposes a corresponding flange surface 32 facing axially aft. In one non-limiting embodiment, the corresponding recess and flange surfaces form a sealing engagement to reduce leakage of cooling fluid between such surfaces.

Figure 3:
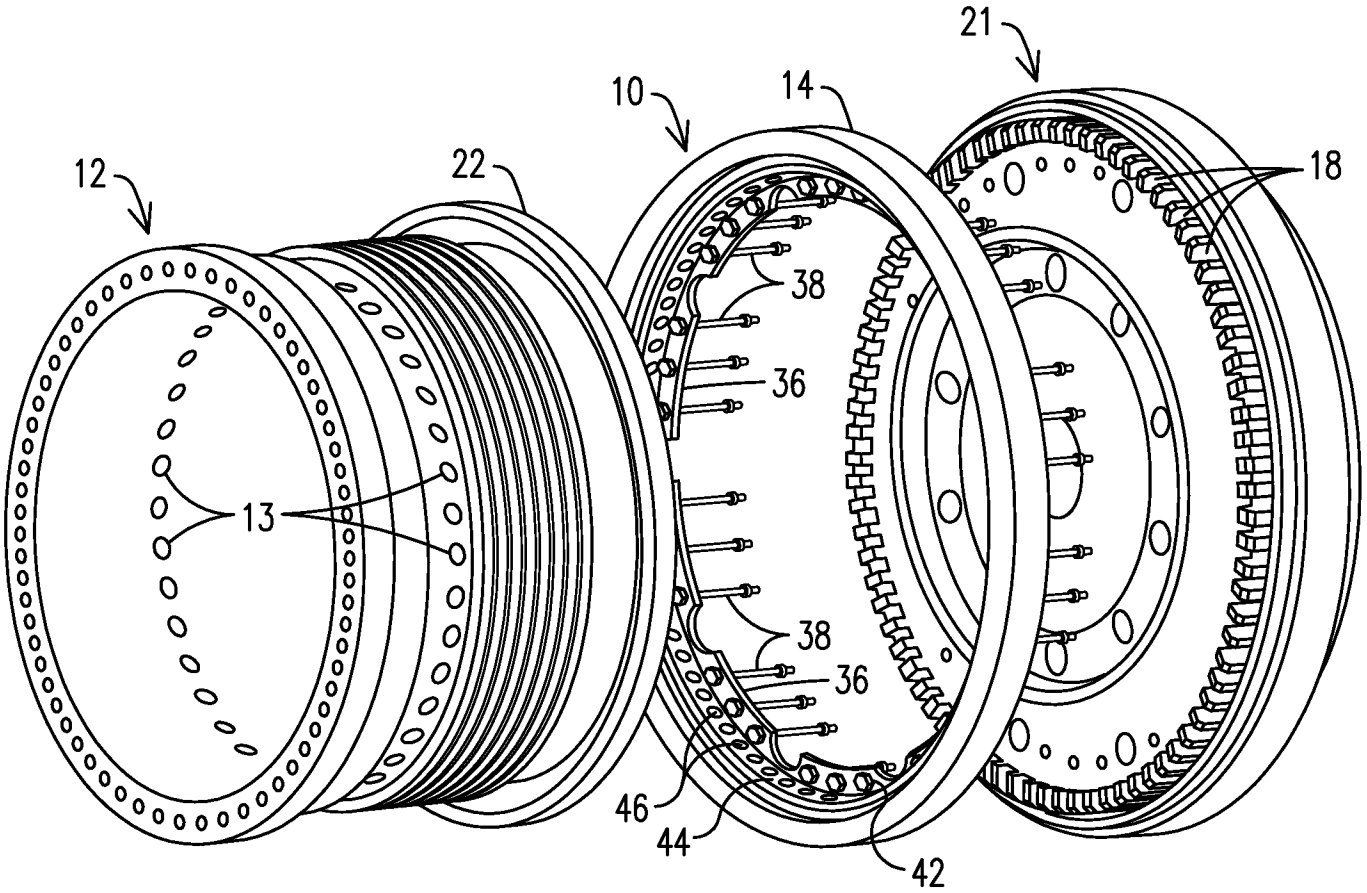
FIG. 3 is an isometric, exploded view of the air separator including a turbine disk.

Aft air separator member 10 comprises radially-extending flanges 36 axially affixed by way of a respective plurality of axially-extending bolts 38 to a disc wall 40 of the first stage of the turbine engine comprising turbine disc 21. Each radially-extending flange 36 (as may be appreciated in FIG. 3) comprises a plurality of holes 42 circumferentially disposed on the radially-extending flanges 36 to receive the axially-extending bolts 38 affixed to disc wall 40.

In one non-limiting embodiment, annular frame 14 comprises a radially inward portion 44 (FIG. 2) comprising a plurality of openings 46 for radially conveying the cooling fluid to respective cooling disc channels. In one non-limiting embodiment, annular frame 14 further comprises a radially outward portion 50 including an end surface 52 arranged to form a sealing engagement with a corresponding surface of the turbine disk 21 in the first stage of the turbine engine to reduce leakage of cooling fluid between such surfaces.

In one non-limiting embodiment, as may be appreciated in FIG. 2, aft air separator member 10 and forward separator member 12 in combination extend to a predefined radial height (H), and a radially outward end of flange 22 (e.g., flange surface 28) of the forward separator member 12 extends to a flange radial height (Hfl), which is no more than approximately 60 percent of the predefined radial height H. In one non-limiting embodiment, the flange radial height may comprise a range from approximately 40 percent to approximately 60 percent of the predefined radial height H. It will be appreciated that the foregoing ranges should be construed as non-limiting examples and should not be construed as limiting aspects of the invention. For example, as would be appreciated by one skilled in the art, the foregoing ranges could be optionally adjusted based on re-arrangement of the axially-extending bolts 38 for aft air separator member 10. It will be appreciated that the split construction and geometrical shape of the proposed air separator is conducive to a relatively lower mass, and is further conducive to an improved center of gravity location (e.g., located relatively more radially inwardly in view of the reduced radial height (Hfl) of forward separator member 12). The foregoing considerations advantageously result in an overall mechanically stiffer construction for the air separator, which in turn mitigates against mechanical imbalances and ensures concentricity with the rotor system.

In operation, an air separator comprising two air separator members, as disclosed above, is expected to result [for a given tilt angle condition] in approximately a 60% reduction in load imbalance compared to a known baseline air separator design due to the relatively lower mass and the improved center of gravity location for the proposed air separator contributed by the configuration of the air separator members.

The aft and forward air separator members is each individually constrained from movement along the radial direction, thus insuring an appropriate degree of concentricity in the rotor system notwithstanding of thermal changes that may occur during an entire operating cycle of the turbine engine.

While various embodiments of the present invention have been shown and described herein, it will be apparent that such embodiments are provided by way of example only. Numerous variations, changes and substitutions may be made without departing from the invention herein. Accordingly, it is intended that the invention be limited only by the spirit and scope of the appended claims.

The invention claimed is:

1. An air separator for a turbine engine, the air separator comprising:

an aft air separator member comprising an annular frame which defines a chamber configured to engage disc shoulders configured in a first stage of the turbine engine, the aft air separator member being constrained from movement along a radial direction by the disc shoulders engaged in the chamber of the aft air separator member; and a forward air separator member affixed at a forward end thereof to a torque tube to constrain movement along the radial direction, the forward air separator comprising at an aft end thereof a flange that engages the aft air separator member, the forward air separator member being constrained from outward radial movement along the radial direction by way of a recess constructed in a portion of the aft air separator member, wherein the annular frame comprises a radially inward portion comprising a plurality of openings for radially conveying cooling fluid to respective cooling disc channels.

2. The air separator of claim 1, wherein the recess comprises a recess surface facing radially inward that opposes a corresponding flange surface disposed at a radially outward end of the flange of the forward air separator member, wherein the recess further comprises a recess surface facing axially forward that opposes a corresponding flange surface facing axially aft.

3. The air separator of claim 1, wherein the aft air separator member comprises a radially-extending flange axially affixed to a disc wall of the first stage of the turbine engine.

4. The air separator of claim 3, wherein the radially-extending flange comprises a plurality of holes circumferentially disposed on the radially-extending flange to receive a respective plurality of axially extending bolts affixed to the disc wall.

5. The air separator of claim 1, wherein the annular frame further comprises a radially outward portion including an end surface arranged to form a sealing engagement with a corresponding surface of the disk in the first stage of the turbine engine to reduce leakage of cooling fluid there between.

6. The air separator of claim 2, wherein the corresponding recess and flange surfaces form a sealing engagement to reduce leakage of cooling fluid there between.

7. The air separator of claim 1, wherein the aft air separator member and the forward separator member in combination extend to a predefined radial height, wherein a radially outward end of the flange of the forward separator extends to a flange radial height which is no more than approximately 60 percent of the predefined radial height.

8. The air separator of claim 7, wherein the flange radial height comprises a range from approximately 40 percent to approximately 60 percent of the predefined radial height.

9. A turbine engine comprising the air separator of claim 1.

10. An air separator for a turbine engine, the air separator comprising:

an aft air separator member constrained by an anchoring structure from movement along a radial direction; and a forward air separator member comprising at an aft end thereof a flange that engages the aft air separator member, the forward air separator member being constrained from outward radial movement along the radial direction by way of a recess constructed in a portion of the aft air separator member, wherein the aft air separator member and the forward separator member in combination extend over a predefined radial height, wherein a radially outward end of the flange of the forward separator extends to a flange radial height which is no more than approximately 60 percent of the predefined radial height, wherein the aft air separator member comprises an annular frame which defines a chamber configured to engage disc shoulders configured in a first stage of the turbine engine, wherein the disc shoulders engaged in the chamber of the air separator member constitute the anchoring structure that constrains movement along the radial direction, and wherein the annular frame comprises a radially inward portion comprising a plurality of openings for radially conveying cooling fluid to respective cooling disc channels.

11. The air separator of claim 10, wherein the flange radial height comprises a range from approximately 40 percent to approximately 60 percent of the predefined radial height.

12. The air separator of claim 10, wherein the recess comprises a recess surface facing radially inward that opposes a corresponding flange surface disposed at the radially outward end of the flange of the forward air separator member, wherein the recess further comprises a recess surface facing axially forward that opposes a corresponding flange surface facing axially aft, wherein the corresponding recess and flange surfaces form a sealing engagement to reduce leakage of cooling fluid there between.

13. The air separator of claim 10, wherein the aft air separator member comprises a radially-extending flange axially affixed to a disc wall of the first stage of the turbine, wherein the radially-extending flange comprises a plurality of holes circumferentially disposed on the radially-extending flange to receive a respective plurality of axially extending bolts affixed to the disc wall.

14. The air separator of claim 11, wherein the annular frame comprises a radially inward portion comprising a plurality of openings for radially conveying cooling fluid to respective cooling disc channels.

15. The air separator of claim 14, wherein the annular frame further comprises a radially outward portion including an end surface arranged to form a sealing engagement with a corresponding surface of the disk in the first stage of the turbine engine to reduce leakage of cooling fluid there between.

16. A turbine engine comprising the air separator of claim 10.

* * * * *